United States Patent [19]

Roeder

[11] 4,321,015

[45] Mar. 23, 1982

[54] DOWNHOLE, HYDRAULICALLY ACTUATED PUMP ASSEMBLY WITH PRESSURE SETTABLE PACKER NOSE ASSEMBLY

[76] Inventor: George K. Roeder, P.O. Box 1435, Odessa, Tex. 70760

[21] Appl. No.: 104,261

[22] Filed: Dec. 17, 1979

[51] Int. Cl.[3] ..... F04B 47/12

[52] U.S. Cl. ..... 417/56; 166/202; 277/30; 277/34; 277/116.6; 417/555 A

[58] Field of Search ..... 417/56–60, 417/555 A; 166/202, 187; 277/30, 116.6, 34, 34.3, 34.6

[56] References Cited

U.S. PATENT DOCUMENTS

| | | | |
|---|---|---|---|
| 1,883,053 | 10/1932 | Standlee | 417/555 A |
| 2,714,855 | 8/1955 | Brown | 417/57 |
| 3,456,724 | 7/1969 | Brown | 166/202 X |
| 3,554,279 | 1/1971 | Meripol et al. | 166/202 X |
| 3,915,595 | 10/1975 | Roeder | 417/393 |
| 3,957,400 | 5/1976 | Roeder | 417/393 |

*Primary Examiner*—Louis J. Casaregola
*Assistant Examiner*—Edward Look
*Attorney, Agent, or Firm*—Marcus L. Bates

[57] ABSTRACT

A packer nose assembly for a downhole, hydraulically actuated pump of the free-type. The packer nose assembly is connected to the upper end of the pump device, and includes a packer apparatus interposed between the pump and a pair of seal cups. The seal cups are identical in construction and inverted respective to one another. The seal cups and the packer device are of annular construction and are telescopingly received in axially aligned relationship upon a mandrel. The mandrel is attached to the upper end of the pump. The cups enable the entire pump assembly to be pumped into and out of a borehole. The pump is circulated downhole through a power oil tubing string where the inlet end of the pump is seated against a conventional seating shoe. Thereafter, power fluid flows down the tubing and into the upper end of the mandrel, and through the central passageway of the mandrel to the valve assembly of the pump engine. At the same time, the lower cup assembly acts as a piston and reciprocates respective to the mandrel, and abuttingly engages one end of the packer apparatus. This reciprocal action causes compression of the opposed ends of the packer device, which in turn outwardly expands a packer rubber, so that the annular area between the packer nose assembly and the power oil string is positively and efficiently packed off. This action biases the entire pump assembly into seating engagement respective to the shoe, and at the same time anchors the pump downhole in an improved manner.

9 Claims, 4 Drawing Figures

DOWNHOLE, HYDRAULICALLY ACTUATED PUMP ASSEMBLY WITH PRESSURE SETTABLE PACKER NOSE ASSEMBLY

BACKGROUND OF THE INVENTION

In my previous U.S. Pat. Nos. 3,957,400 and 3,915,595, there is disclosed a downhole, hydraulically actuated pump assembly which can be circulated into and out of a borehole. In my copending patent application Ser. No. 001,093, filed Jan. 5, 1979, now abandoned, there is disclosed a packer nose assembly which can be used in conjunction with downhole apparatus such as exemplified by these two recited patents. The packer nose assembly includes a pair of spaced apart cup devices which are arranged in spaced relationship respective to one another so that the rubber elements of the cup sealingly engages the interior of the tubing string as the pump assembly is circulated downhole.

Circulation of power fluid downhole to a hydraulically actuated pump so that produced fluid, along with the spent power fluid, is forced up to the surface of the ground—requires a substantial amount of energy. In a free-type pump, it is absolutely essential that the production inlet be efficiently sealed to the seat formed in the lower shoe, and that the annulus formed between the upper end of the pump and the tubing string be absolutely sealed off, or otherwise power fluid is wasted.

Moreover, as the pump engine reciprocates the production pump, vibratory energy can cause harmonic motion to be induced into various different downhole pump components. This action can cause undesirable motion between the pump and the pump cavity.

The seal means on a packer nose assembly must sometime travel more than two miles through the interior of the tubing string and therefore the cups are subjected to considerable wear. Moreover, debris can become lodged outwardly of the rubber seal element of the seal cup, and this also promotes leakage across the pump annulus.

It would therefore be desirable to have a packer apparatus which augments the sealing action of the seal cup, and which furthermore positively anchors the entire pump device downhole in the borehole. It would be desirable if such an apparatus could be actuated by the same fluid pressure which powers the engine of the downhole pump. An apparatus which achieves these desirable results is the subject of the present invention.

SUMMARY OF THE INVENTION

This invention comprehends an improved pressure settable packer nose assembly for a hydraulically actuated downhole pump of the free-type. The packer nose assembly has a lower end attached to the upper end of the pump assembly, and includes a plurality of sealing elements arranged thereon which sealingly engage the inner surface of a tubing string so that fluid cannot flow between the annulus formed between the packer nose assembly and the tubing string.

A centrally located mandrel extends along the longitudinal axial centerline of the pump. A packer device, an upper seal cup device, and a lower seal cup device are axially aligned respective to one another and to the mandrel and the pump, with each of these apparatus being mounted onto the mandrel. The seal cups are inverted respective to one another, and spaced apart from one another. The seal cup which upwardly opens is slidably received upon the mandrel and connected to abuttingly engage and set the packer device.

The packer device includes a resilient, cylindrical body having reduced diameter marginal end portions, each of which are received within a mount member, with the mount members being spaced from one another, and with one of the mount members being slidably received exteriorly of the mandrel.

The pump is circulated downhole through the tubing string until the inlet of the production end thereof abuttingly engages the lower end of the pump receiving cavity, so that the pump production inlet is placed in communication with the formation fluid supply. Hydraulic pressure, effected from the surface of the earth, flows down the power oil tubing string, into the upper end of the mandrel, and provides a source of power oil for the engine end of the pump apparatus. At the same time, the upwardly directed seal cup is forced to slide downwardly under the force of the power fluid, and forces one of the moveable mount members to move towards the opposed mount member, thereby compressing the resilient, cylindrical body in an outward direction. This action causes the annulus between the packer nose assembly and the power oil tubing string to be packed off, thereby providing dual seal means, and centralizing the entire pump assembly.

The pump is retrieved by circulating fluid uphole through the power tubing string, whereupon the fluid pressure effected upon the upwardly directed seal cup is relaxed, and the downwardly directed seal cup slidably and sealingly engages the wall of the tubing string so that sufficient upthrust can be achieved to retrieve the entire pump assembly.

Accordingly, a primary object of the present invention is the provision of improvements in a packer nose assembly for a hydraulically, actuated downhole pump of the free-type.

Another object of the present invention is the provision of a packer nose assembly for circulating a free-type downhole pump assembly into and out of a borehole, and providing the pump assembly with a positive pressure actuated packer device which precludes leakage of power fluid away from the engine power oil inlet.

A further object of this invention is the provision of an improved packer nose assembly in combination with a free-type downhole hydraulically actuated pump which provides means by which the pump can be circulated into and out of the borehole, and at the same time, provide a pressure actuated pack off device which centers the pump in the pump cavity and prevents the pump inlet from wearing against the lower pump seat.

A still further object of this invention is the provision of an improved packer nose assembly having a plurality of spaced apart seal elements thereon, wherein one of the seal elements enables the entire pump assembly to be pumped downhole, another of the seal elements enables the entire apparatus to be circulated out of the borehole, and another of the seal elements positively seals the annulus formed between the pump device and the interior of the power oil string.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
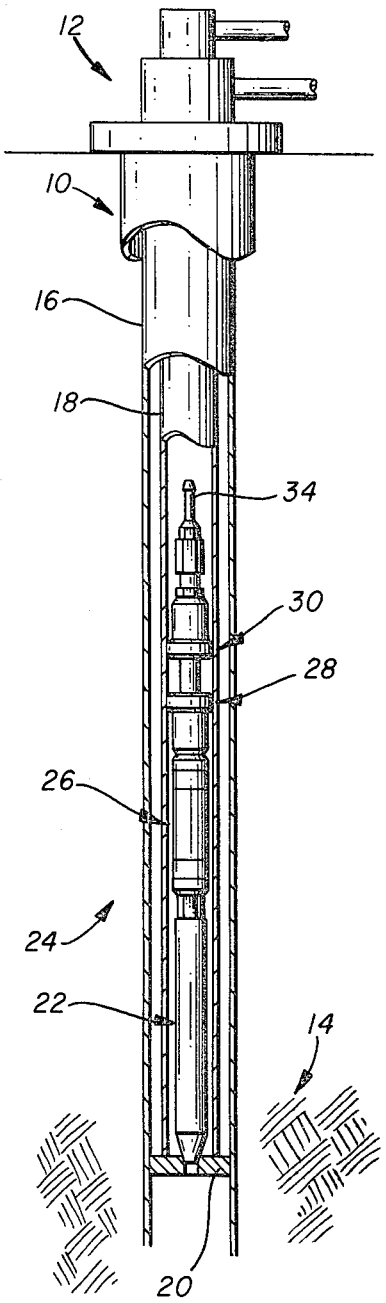
FIG. 1 is a broken, diagrammatical representation of a vertical cross-section of an oil well having apparatus therein made in accordance with the present invention.

In FIG. 1, there is disclosed a borehole 10 which terminates in a wellhead 12 at the upper end thereof, and which extends downhole to a production formation 14. The borehole is cased at 16, and includes a power oil tubing string 18. A bottomhole pump shoe 20 forms a seat at the lowermost end of a pump cavity, and enables production fluid to flow from the formation 14 into the inlet end of a hydraulically actuated, downhole, free-type pump assembly 22 when the pump is properly seated therewithin. The pump assembly includes a packer nose assembly 24, made in accordance with the present invention. The pump assembly can take on any number of different forms.

Figure 2:
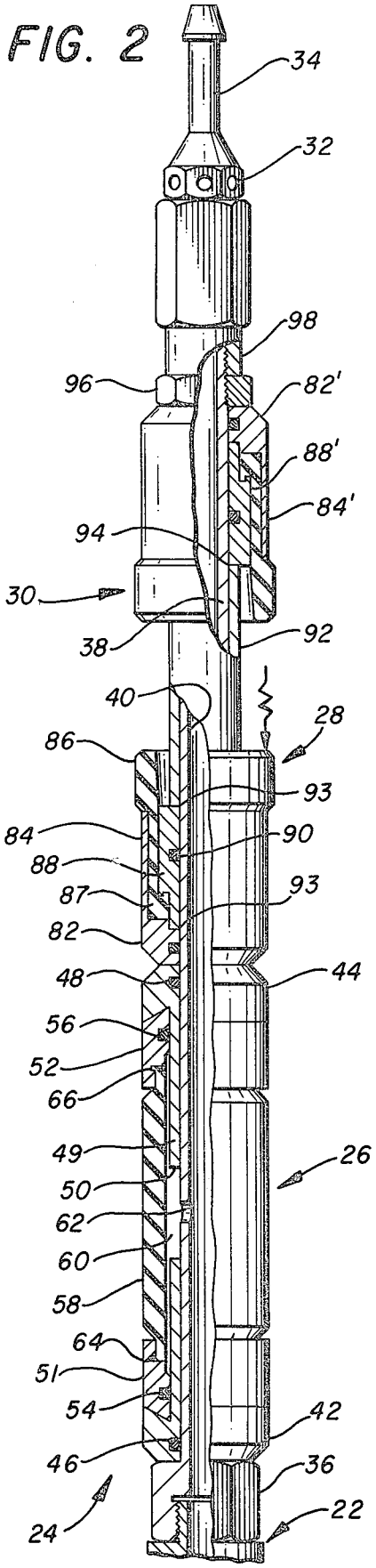
FIG. 2 is an enlarged, broken, part cross-sectional, elevational view of part of the apparatus disclosed in FIG. 1.

In FIG. 2, together with the other figures of the drawings, the packer nose assembly 24 is seen to include a plurality of sealing elements thereon, each of which sealingly engages the intervening annulus formed between the pump assembly and the inside peripheral wall surface of the power oil tubing. The sealing elements include a packer device 26, a lower seal cup 28, and an upper seal cup 30. The seal cups 28 and 30 preferably are made in accordance with my co-pending patent application Ser. No. 001,093 filed Jan. 5, 1979, to which reference is made for additional and more specific details thereof.

The packer nose assembly 24 of this invention includes an upper end which forms a power fluid inlet at 32, from which a fishing neck 34 upwardly extends. The lower end of the packer nose assembly includes a sub 36 by which the entire packer nose assembly is attached to the upper end of one of the before mentioned pump apparatus 22. The innermost part of the packer nose assembly includes a mandrel 38 which is affixed to a sub 36 and which extends along the longitudinal axial centerline of the pump assembly and packer nose assembly, and terminates at the before mentioned fishing neck. Hence, the mandrel 38 extends from attached relationship respective to a sub 36, and terminates in the fishing neck, and includes a hollow interior 40 which communicates the pump engine valve assembly (not shown) with the power oil inlet 32.

The packer device 26 includes opposed end members 42 and 44 which sealingly engage the smooth exterior surface of the mandrel by means of o-rings 46 and 48. Skirt member 49 is an integral part of the end member. Each skirt member extends towards one another and terminates in edge portion 50.

Opposed packer mount members 51 and 52 are slidably received in sealed relationship respective to the adjacent spaced skirt members by means of o-ring seals 54 and 56.

A resilient packer element 58 is reduced in diameter at the marginal opposed end portions. As seen in FIG. 2, the marginal end portions are captured within each of the rubber mount members. An annular pressure chamber 60 communicates with the interior of the mandrel by means of port 62 formed in the mandrel.

Figure 3:
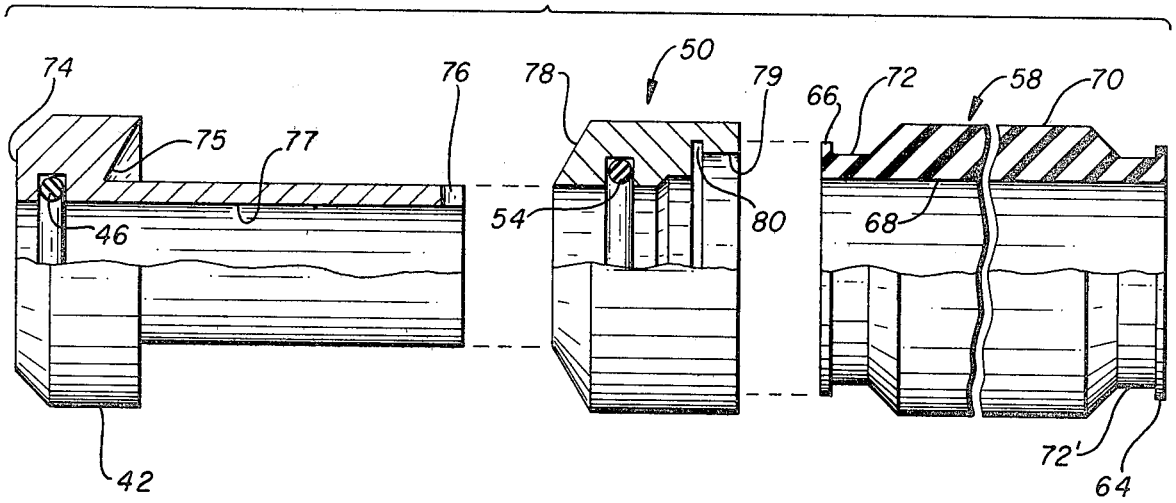
FIG. 3 is a part cross-sectional, exploded view of part of the apparatus disclosed in FIG. 2; and, FIG. 4 is a fragmented, part cross-sectional view which discloses part of the apparatus of FIG. 2 in a different operative configuration.

As particularly disclosed in FIG. 3, the packer rubber includes the before mentioned opposed end portions which terminate in a circumferentially extending lip at 64 and 66. The inside circumferential extending wall surface 68 is of a size to be slidably received in close tolerance relationship respective to the exterior of the skirt members. The medial outer body portion 70 is reduced in diameter at 72 so that the marginal ends of the rubber can be tightly received in captured relationship within the mount member 50.

The marginal opposed ends 74 of the end members are machined into a boss having one face arranged perpendicular to the mandrel and another face 75 arranged at an angle thereto. A semicircular port 76 is formed at the adjacent terminal ends of each skirt, so that when the ends abuttingly engage one another, fluid can flow therethrough and into chamber 60. The inside passageway 77 of the end members is slidably received about the exterior of the mandrel.

The mount member 50 is provided with frusto conical surface 78 made complementary respective to the surface 75 of member 42 so that the two surfaces are received in close tolerance relationship respective to one another. The other end of member 50 is provided with a circumferentially extending lip 79 which cooperates with the skirt to form an outwardly opening annulus within which the marginal ends of the rubber are received therewithin. Annular groove 80 of each member tightly receives one of the lips 64 or 66 therewithin, thereby capturing the marginal ends of the rubber packer element within the rubber mount member.

Looking again now to FIG. 2, it will be noted that each of the seal cups is comprised of a housing 82, 82' having a boss which slidably and sealingly engages the exterior surface of the mandrel. The boss continues as a skirt member 84 which terminates to leave a marginal end portion of a rubber cup member 86 outwardly expanded towards the inner wall of the tubing string. The rubber cup is compressed within the annulus formed between the housing and the inner cup support 88. The inner cup support includes o-ring seal 90 which seals the surface presented between the mandrel and the interior wall of the support.

Cup spacer 92 maintains the upper and lower seal cups spaced from one another. The opposed ends of the spacer abuttingly engages the end of member 88, as indicated by numeral 93; and, the end of member 88', as indicated by numeral 94.

Lock nut 96 engages the upper end face of housing 82', while upper sub 98 serves as a jam nut thereagainst.

OPERATION

The packer nose assembly 24 can be used in conjunction with any downhole fluid operated pump. The packer nose assembly of the present invention is attached to the uppermost end of the pump by means of any suitable sub 36. The sub continues along the axial centerline of the assembly and terminates at sub 98, to which there is attached the fishing neck 34. The fishing neck enlarges at 32, and is provided with the illustrated radially spaced ports which form the inlet into the interior 40 of the hollow mandrel.

Figure 4:
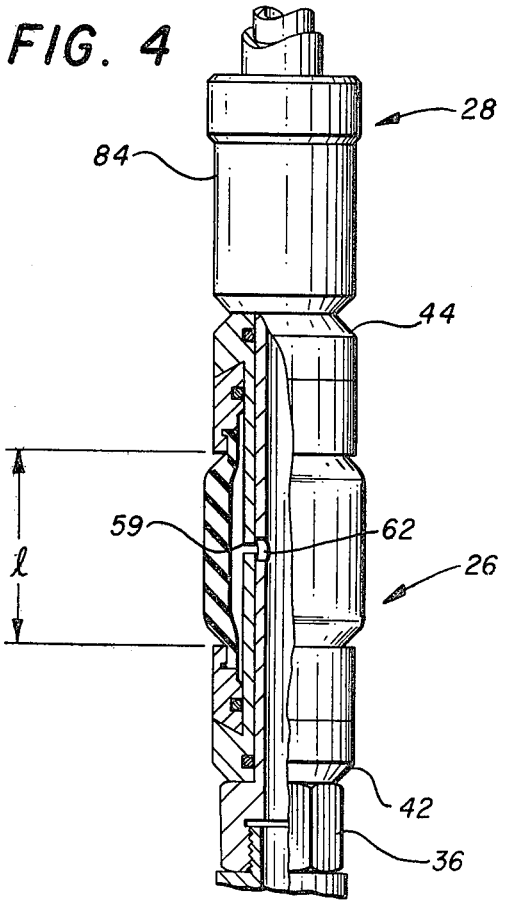

The packer apparatus 26 is assembled by mating the component parts of FIG. 3 into the configuration seen in FIGS. 2 and 4, and slide into operative position on the mandrel. Next, two seal cups are inverted respective to one another so that the cups thereof are facing one another in the manner of FIG. 2. The seal cups are mounted onto the mandrel with the spacer 92 being interposed therebetween. Next, the nut 96, sub 98, and fishing neck are screwed into position and the entire pump assembly is now ready to be run downhole through the power oil tubing string.

The entire pump apparatus is circulated down through the tubing string by applying pressure at the wellhead. The seal cup 28 sealingly engages the interior of the tubing string in a slidable manner as the apparatus is pumped downhole until the pump production intake seats against the seat of shoe 20. As the pressure effected from the power fluid source enters the packer nose assembly at 32, the power oil flows through the interior of the mandrel, and down to the engine of the hydraulically, actuated pump. At the same time, pressure is effected across the upper seal cup 30, which expands seal cup 28 outwardly against the tubing wall while concurrently forcing the lower seal cup in a downward direction due to the pressure differential effected thereacross. This action forces housing 82 to abuttingly engage the upper end 44 of the packer device, whereupon the members 44 and 42 are forced to move towards one another, thereby moving members 51 and 52 towards one another, and compressing the resilient rubber 58. At the same time, power fluid flows through port 62 and into annulus 60. This sequence of events expands the rubber 58 outwardly against the wall of the cavity, or the power string, so that the downhole pump apparatus is positively locked into position, with there being a downward thrust of the pump production intake against the seat of the seating shoe, and thereby accurately positions the pump at its proper downhole position in a superior manner.

I claim:

1. In a free-type hydraulically, actuated downhole pump assembly which can be circulated into and out of a power oil tubing string, the combination with said downhole pump of a packer nose assembly;

said packer nose assembly includes a hollow central mandrel having one end adapted to be attached to the upper end of a pump assembly;

a packer device telescopingly received about said mandrel, said packer device comprises upper and lower end members having an enlarged head thereof from which there extends a skirt member;

seal means between said end members and said mandrel with one of said end members being slidably received in a reciprocating manner upon said mandrel;

said enlarged head of said end members each being opposed to one another, and each said skirt member being located adjacent to one another;

a cylindrical packer rubber having a medial body portion and opposed marginal end portions;

a mount member slidably received about each said skirt member, seal means positioned between each said mount means and the exterior of said skirt, a circumferentially extending shoulder arranged to form an annular cavity between each skirt member and mount member within which the marginal ends of the packer rubber is received in captured relationship therewith;

a seal cup device; said seal cup device and said packer device being axially aligned respective to one another, said seal cup device having a circumferentially extending sealing element which upwardly opens so that downward flow of fluid through the tubing string forces the sealing element to expand into engagement with the interior of the tubing string;

said seal cup device being slidably received upon said mandrel and abuttingly engaging said head of said upper end member so that as the seal cup device is forced in a downward direction, the packer rubber is compressed between the opposed heads, thereby forcing the packer rubber to expand outwardly into engagement with the interior of the tubing string.

2. The combination of claim 1 wherein said packer rubber is reduced in diameter at each said marginal end thereof; said packer rubber is of a length to cause said skirt member to be spaced apart from one another, when the rubber is in the relaxed configuration, so that when the seal cup device moves the end members towards one another, the adjacent ends of the skirt members abuttingly engage one another to thereby prevent further compression of the packer rubber.

3. The combination of claim 2 wherein said packer rubber includes an outwardly directed lip on each said marginal end thereof which circumferentially extends thereabout;

each of said mount members include a circumferentially extending annular groove formed thereon which is part of said annular cavity, said lip is sealingly captured within said groove so that fluid flow thereacross is precluded.

4. The combination of claim 3 wherein there is included an upper seal cup device spaced from the first recited seal cup device to thereby provide upper and lower seal cup devices, each said seal cup device includes a housing having a circumferentially extending skirt extending therefrom, a resilient cup member having a marginal body portion received within said skirt, and an inner cup support which captures the resilient cup member thereabout;

one said inner cup support being slidably received in a sealed manner about said mandrel, so that one of the seal cup devices act as a piston and forces the packer rubber to expand in the before recited outward direction.

5. The packer nose assembly of claim 4 wherein said upper and lower seal cup devices are slidably captured in a sealed manner to said mandrel, and further including stop means by which the travel of said seal cup devices is limited;

said upper seal cup device having a resilient seal element which downwardly opens and therefore permits fluid flow in a downward direction thereacross while precluding flow of fluid in an upward direction thereacross so that said pump assembly can be pumped out of said tubing string by reverse circulation.

6. In a hydraulically, actuated downhole pump assembly having a packer nose assembly located at the upper end thereof which enables the pump assembly to be circulated down through a tubing string into a pump cavity where the lower end of the pump is sealingly seated against a shoe, the improvement comprising:

said packer nose assembly includes a centrally located mandrel having opposed ends, one end of the mandrel being connected to the upper end of the pump assembly;

a packer device, an upper seal cup device, and a lower seal cup device; said packer device, said upper and lower seal cup devices, and said mandrel being axially aligned along a common longitudinal axial centerline and slidably mounted to the mandrel, with the packer device being located adjacent to one of said seal cup devices;

the adjacent seal cup device having an upwardly and outwardly opening resilient seal element associated therewith which prevents downward flow of fluid through the tubing string and which permits upward flow of fluid thereacross; said adjacent seal cup device being slidably mounted on said mandrel; said packer device being located below said adjacent seal cup device and placed into abutting engagement therewith;

spaced apart end members, a resilient packer element having opposed marginal ends received within said spaced apart end members; said packer device being slidably received upon said mandrel, said opposed end members being moveable towards and away from one another;

said resilient packer element is of a length to cause said opposed end members to be spaced apart from one another, when the resilient packer element is in the relaxed configuration, so that when the seal cup device moves the end members towards one another, the adjacent opposed end members abuttingly engage one another to thereby prevent further compression of the rubber;

so that, fluid pressure effected upstream of said packer nose apparatus forces the adjacent seal cup to move into abutting engagement respective to the packer device, whereupon the opposed end members of the packer device move towards one another, thereby compressing the resilient packer element therebetween and expanding the element against the sidewalls of the tubing string.

7. The improvement of claim 6 wherein said resilient packer element includes an outwardly directed lip formed on each marginal end thereof which circumferentially extends thereabout;

each of said mount members include a circumferentially extending annular groove formed thereon within which said lip is captured so that fluid flow thereacross is precluded.

8. The improvement of claim 7 wherein each said seal cup device includes a housing having a circumferentially extending skirt extending therefrom, a resilient cup member having a marginal body portion received within said skirt, and an inner cup support which captures the resilient cup member therewithin;

one said inner cup support being slidably received in a sealed manner about said mandrel, so that one of the seal cup devices act as a piston to force the packer nose to expand in an outward direction.

9. The improvement of claim 8 wherein said upper and lower seal cup devices are slidably captured in a sealed manner to said mandrel, and further including stop means by which the longitudinal travel of said seal cup devices respective to the mandrel and opposed end members are limited;

said resilient cup member of said upper cup device downwardly opens and therefore permits fluid flow in a downward direction thereacross while precluding flow of fluid in an upward direction thereacross so that said pump assembly can be pumped out of said tubing string by reverse circulation.

* * * * *

UNITED STATES PATENT OFFICE

CERTIFICATE OF CORRECTION

Patent No. 4,321,015 Dated March 23, 1982

Inventor(s) GEORGE K. ROEDER

It is certified that error appears in the above-identified patent and that said Letters Patent are hereby corrected as shown below:

Column 1, lines 11 and 12, delete "now abandoned," after 1979;

Signed and Sealed this

*Twelfth* Day of *October 1982*

[SEAL]

*Attest:*

GERALD J. MOSSINGHOFF

*Attesting Officer* *Commissioner of Patents and Trademarks*